US005483424A

United States Patent [19]

Lightbody

[11] Patent Number: 5,483,424

[45] Date of Patent: Jan. 9, 1996

[54] LIGHTING APPARATUS

[75] Inventor: Derek C. Lightbody, Hertfordshire, United Kingdom

[73] Assignee: Optical & Textile Limited, London, United Kingdom

[21] Appl. No.: 318,674

[22] PCT Filed: Apr. 14, 1993

[86] PCT No.: PCT/GB93/00781

§ 371 Date: Oct. 14, 1994

§ 102(e) Date: Oct. 14, 1994

[87] PCT Pub. No.: WO93/21473

PCT Pub. Date: Oct. 28, 1993

[30] Foreign Application Priority Data

Apr. 15, 1992 [GB] United Kingdom ..... 9208338
Jul. 2, 1992 [GB] United Kingdom ..... 9214193

[51] Int. Cl.[6] ..... F21V 7/00

[52] U.S. Cl. ..... 362/17; 362/300; 362/348

[58] Field of Search ..... 362/17, 297, 300, 362/307, 328, 343, 348

[56] References Cited

U.S. PATENT DOCUMENTS

| | | | |
|---|---|---|---|
| 1,915,842 | 6/1933 | Winkler . | |
| 2,538,638 | 1/1957 | Wilson . | |
| 3,450,459 | 6/1969 | Haggerty . | |
| 3,671,101 | 6/1972 | Finch . | |
| 3,799,646 | 3/1974 | Footchkar . | |
| 4,035,631 | 7/1977 | Day, Jr. . | |
| 4,209,825 | 6/1980 | Shackelford | 362/328 |
| 4,864,476 | 9/1989 | Lemons et al. | 362/297 |

FOREIGN PATENT DOCUMENTS

| | | | |
|---|---|---|---|
| 0391287 | 3/1990 | European Pat. Off. . | |
| 0430470 | 11/1990 | European Pat. Off. . | |
| 2308050 | 11/1976 | France . | |
| 2808333 | 9/1978 | Germany | 362/348 |
| 132363 | 6/1929 | Switzerland | 362/348 |
| 2172986 | 7/1988 | United Kingdom . | |

OTHER PUBLICATIONS (2) photographs (show an existing softlight which includes an off–axis light source in conjunction with a plain parabolic reflector).

*Primary Examiner*—Ira S. Lazarus
*Assistant Examiner*—Sara Sachie Raab
*Attorney, Agent, or Firm*—Kerkam, Stowell, Kondracki & Clarke; Edward J. Kondracki

[57] ABSTRACT

A light apparatus is provided for illuminating a subject with "soft light", i.e., diffused light that does not cast a defined shadow. The apparatus includes lamp holder (16), a lamp (14), a reflector (12) for reflecting light from the lamp towards the subject, a diffuser or a baffle (23) located in front of the lamp for preventing light from the lamp from passing directly onto the subject. The reflector has a reflecting surface at least 500 mm in diameter and composed of a plurality of convex light-reflecting elements less than 20 mm in diameter. The light reflecting elements (28) constitute at least 90% (by area) of the reflecting surface.

19 Claims, 2 Drawing Sheets

LIGHTING APPARATUS

TECHNICAL FIELD

The present invention relates to the field of lighting, especially for use in television, filming, theatre and photography.

BACKGROUND ART

In order to soften the shadow edges of high-powered lamps used on film and television sets, it is known to reflect light from the lamps off a reflector onto the subject being lit. The reflecting surface of the reflector is not smooth and so light reaches the subject from several pans of the reflecting surface, thereby giving a soft edge shadow; a crinkled or concave stippled sheet of reflecting material has traditionally been used as the reflecting surface. Such an arrangement has a low efficiency and provides an unsatisfactory penumbra region in the shadow; also a significant proportion of the light emitted from the lighting apparatus is wasted and/or is degraded to heat which must be ventilated from the apparatus.

It is an object of the present invention to provide a lighting apparatus that is effective in producing diffused light without sharp shadows (so-called "soft light").

SUMMARY OF THE INVENTION

According to the present invention there is provided a lighting apparatus for illuminating a subject, which apparatus comprises a reflector for reflecting light, from the towards the subject, the reflector comprising a reflecting surface at least 500 mm in diameter and composed of a plurality of convex light-reflecting elements having a diameter not greater than 20 mm, said light reflecting elements constituting at least 90% (by area) of the reflecting surface.

Light from the individual elements of the reflector will fall on the subject being lit and each element can thus cast a separate shadow; however, if the diameter of each element is sufficiently small, no multiple shadow edge will, in practice, be discernible to an onlooker or, in particular, to a camera filming the scene. We have found that the diameter of each element is preferably less than 15 mm and more preferably is less than 10 mm. If each element is too small, reflecting surface becomes more like a plane surface and so the harder the shadow will appear. We thus prefer that each element is at least 0.5 mm in diameter and preferably more than 1 mm in diameter; we have found that an optimum diameter is in the range of 2 to 10 e.g. 3 to 9 mm.

The reflector can be used to reflect light from an external light source, e.g. the sun, onto the subject being illuminated. However the apparatus will generally include a means for holding a lamp, and in that case the apparatus must include means located in front of the lamp for preventing light from passing directly from the lamp onto the subject; the light preventing means can be a diffuser, e.g. a frosted and/or opalescent screen, that diffuses such direct light or a baffle or reflector that blocks all direct light and generally reflects it back onto the main reflecting surface.

It is preferred that each element is immediately adjacent to all its neighbouring elements and that there are substantially no fiat surfaces between such elements, but up to 10% (by area), and preferably up to 5%, of the reflecting surface can be composed of flat areas. The elements are preferably such that they fit together to form a close-packed arrangement without any flat area between them.

When the elements are all identically shaped the lighting apparatus can give rise to interference patterns and so it is preferable that each element should be surrounded by elements, at least some of which are of a different radius of curvature and/or a different diameter to the element in question.

According to the preferred arrangement, each element may have three to ten neighbouring elements, more generally four to eight neighbouring elements.

The convex shape of each element is preferably such that light falling on any element is not reflected onto an immediately-adjacent element and since this would reduce the efficiency of the reflector The tangent of each convex element at the place where it meets an adjacent element is preferably at least 25°, preferably 45° to 75°, e.g. 60°, to the orthogonal; if the reflector is not planar, then the orthogonal is taken with respect to the tangent of the reflector at the convex element being considered.

The diameter of the reflecting surface is preferably at least 500 mm and generally about 600–1000 mm e.g. 600 to 800 min.

The angle of divergence of the beam of light produced by the lighting apparatus is preferably 50° to 150° and more preferably at least 60° to 120° . We have found the optimum divergence angle is about 120° for studio use and 60° to 80° for outdoor location work.

Each convex element is preferably formed as a smooth domed shape and most preferably is part-spherical in contour.

The reflector may have wails that are curved or planar, e.g. it may be generally disk-shaped or pyramidal or generally conical in shape.

The shape of the convex elements and the arrangement of the reflector as a whole with respect to the lamp is preferably such that as much light as possible is reflected out of the lighting apparatus towards the subject rather than onto another section of the reflector. This can be achieved by suitably shaping the reflecting convex elements and by an appropriate choice of the position of the lamp within the lighting apparatus and of the angle of the reflector walls.

For maximum efficiency, the reflecting surface is preferably mirrored; the mirrored surface may have a satin finish, e.g. by coating it with a satin lacquer, to further increase diffusion. Alternatively, the reflecting surface may be white, although it would then be of lower efficiency and further the white surface can discolour, lowering the colour temperature of the light output.

BRIEF DESCRIPTION OF THE DRAWINGS

The present invention will now be described in further detail, by way of example only, with reference to the accompanying drawings, in which.

DESCRIPTION OF THE PREFERRED EMBODIMENTS

Figure 1:
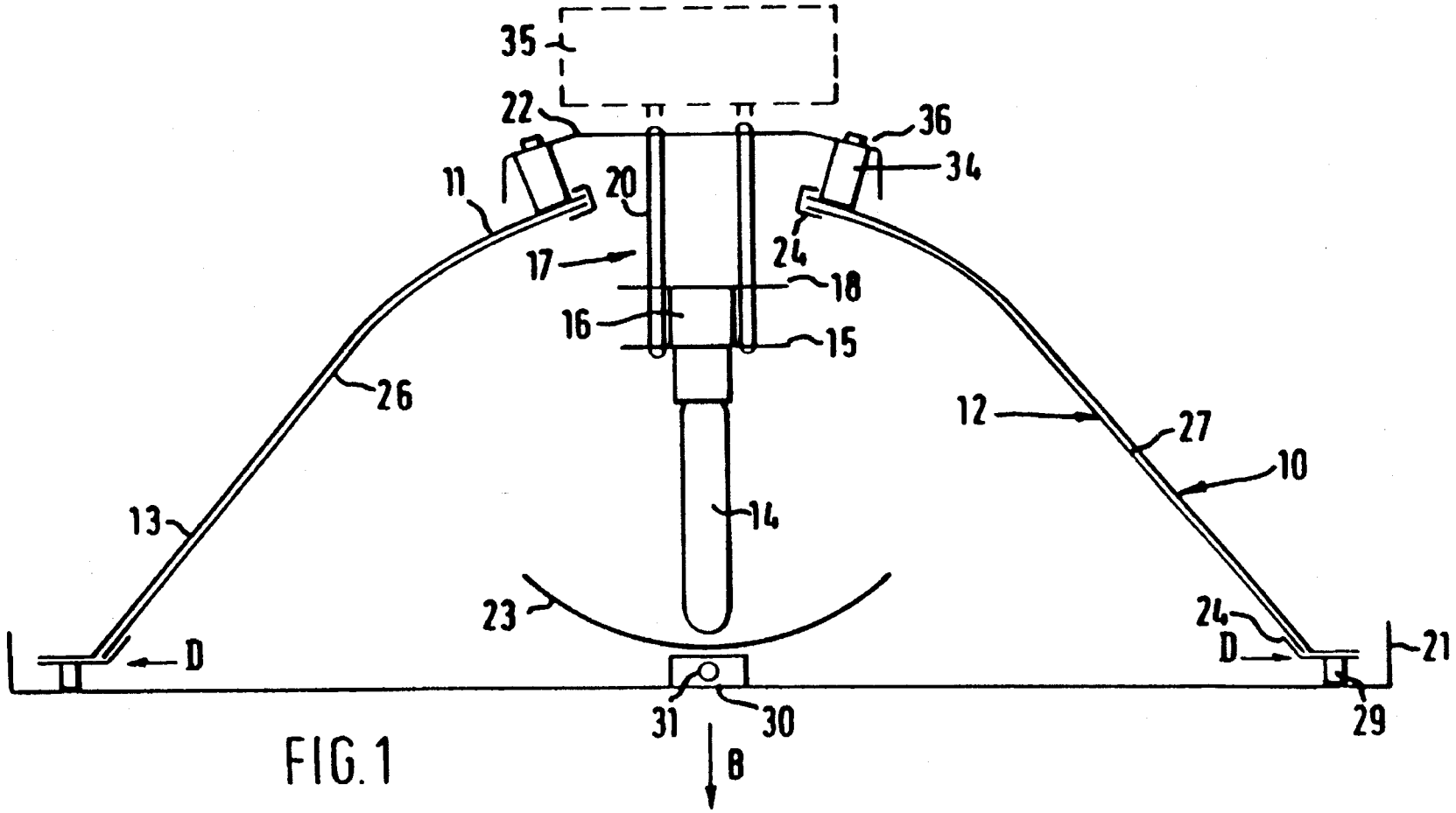
FIG. 1 is a side elevation section, of a lighting apparatus according to the present invention.

Referring initially to FIG. 1 of the accompanying drawings, there is shown a lighting apparatus for providing soft light in a general direction shown by the arrow B in FIG. 1 to illuminate a subject, The apparatus comprises a housing 10 having an internal reflector 12 secured inside it. The housing and reflector are each rotationally symmetric about an optical axis and the top section 11 has a part-spherical shape while the outer section 13 is part-conical in shape. The diameter D of the reflector is at least 500 mm and about 600 mm, in one embodiment or model or, in another embodiment or model, about 800 mm. A discharge lamp 14, which may be an MSR (medium surface rare earth) lamp (as illustrated) or an HMI lamp (or similar discharge lamp) or a tungsten halogen lamp, is held in a lamp socket 16 that in turn is held by a lamp support 17, composed of a mounting plate 18 supported by four columns 20 (only two being visible) from a top mounting 22. A frosted and/or opalescent borosilicate glass diffuser 23 is located immediately in front of the lamp 14 to prevent light emitted by lamp 14 from falling directly onto the subject illuminated, i.e. light emitted from lamp 14 in the direction B is diffused and so does not pass directly in direction B. A heat baffle plate 15 is also included in the support 17.

The reflector 12 may be made by injection moulding a plastic base material and flash-coating a layer of aluminium and a protective layer to form a mirrored internal surface. The reflector may be held within the housing 10 by any suitable means, e.g. it may be stuck to the interior of the housing with adhesive or it may be held by spring clips 24, as shown. Spacers 25 (see FIG. 3) are placed between the reflector and the housing so that there is an air gap 27 between the two that assists in dissipation of heat from the lamp.

Figure 2A:
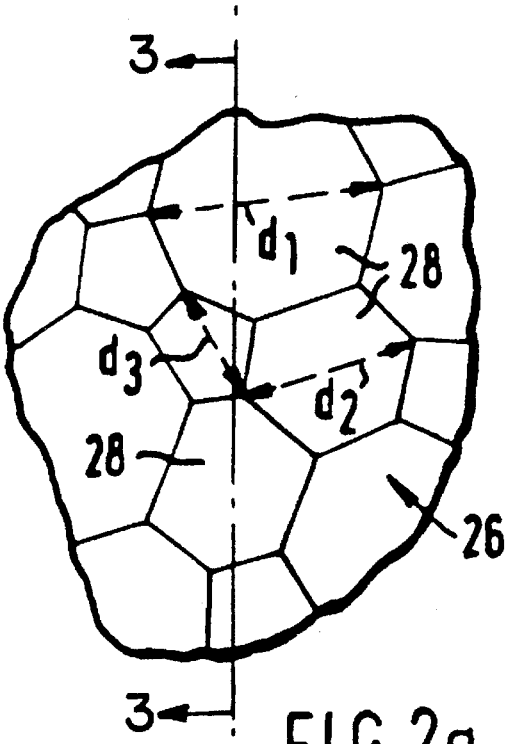
FIG. 2*a* is a plan view of part of the reflecting surface of the lighting apparatus of FIG. 1.

For ease of manufacture, the reflector 12 is made in eight segments that are each held by spring clips 24 to form the complete reflector 12. The internal surface 26 of the reflector 12 is formed by an array of close-packed convex elements 28 shown in details in FIGS. 2*a* and 3; each element has a domed, convex, part-spherical contour (see FIG. 3). Light (shown by arrows C in FIG. 3) falling on each element is reflected from the internal surface of the reflector elements and thereby dispersed along the direction of the arrows C. When all the elements are identical and located in a regular array, interference patterns may be visible and so, as shown, the reflecting elements are of three different diameters $d_1$, $d_2$ and $d_3$, which may be 6.5 mm, 5 mm and 3.5 mm respectively; in addition the elements may nave different radii of curvature $r_1$, $r_2$ and $r_3$.

Figure 2B:
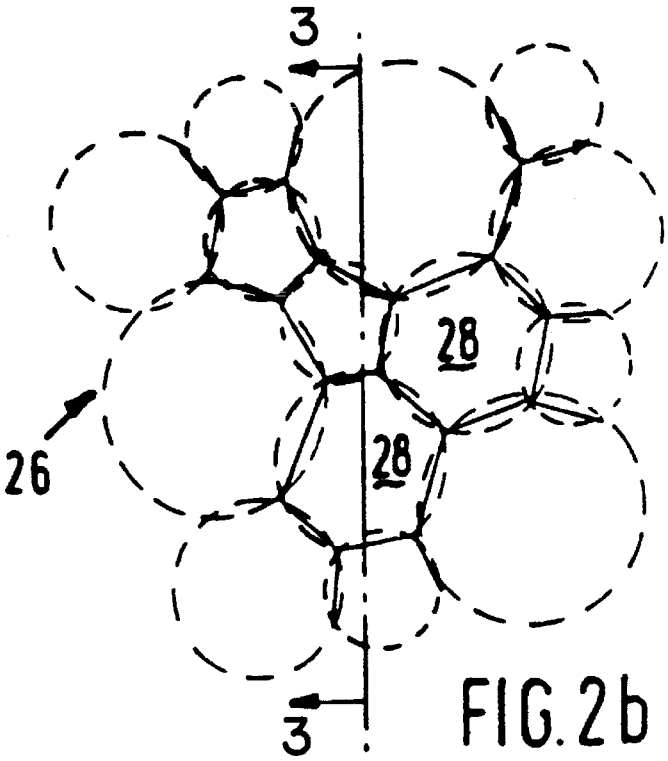
FIG. 2*b* is a schematic view of the same pan of the reflecting surface as FIG. 2*a* but showing how the elements are formed.

As can be seen from FIG. 2*b* each of the elements 28 are so shaped that their edges lie on the intersection between spherical sections shown by dotted lines in FIG. 2*b*.

Figure 3:
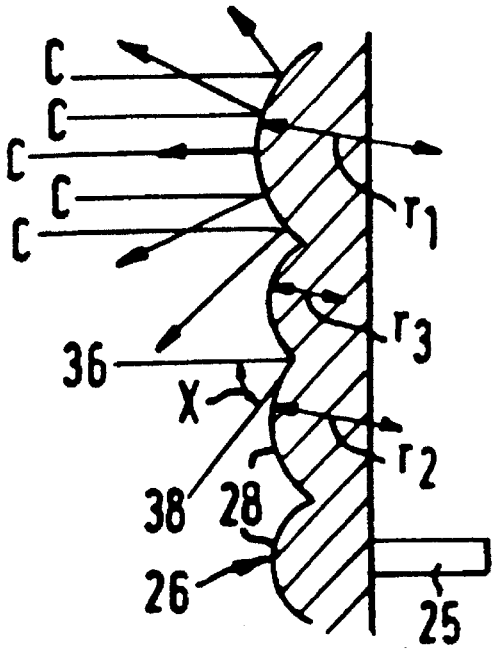
FIG. 3 is a sectional view taken along me lines 3—3 shown in FIG. 2.

The light reflecting elements 28 are smooth part-spherical contoured domes (as seen in FIG. 3); preferably the angle X between the orthogonal 36 of the reflector wall 22 and the tangent 38 of the surface of each dome element at the place where it meets the adjacent element is preferably at least 45° and more preferably about 60°.

A frame 21 is supported on the housing 10 by means of columns 29 and can be used to support an "egg-crate" (not shown), which is an array of horizontal and vertical slats limiting the direction of light emitted from the lamp. Barn doors can also be supported on the frame 21, if required.

The diffuser 23 is supported on a mount 30 held by a rod 31 that is secured at each end to the frame 21 and extends across the face of the apparatus.

Filter frames (not shown) may be held behind and/or in front of the egg-crate to enable coloured filters, ultra-violet filters and/or diffusers to be incorporated in the apparatus; such filter frames are supported on the frame 21.

The lamp 14 and lamp mounting 17 are held by the top mounting 22, which is secured to the housing 10 by means of Dzus bosses 34 and Dzus fasteners 36. The lamp may be easily removed by undoing fasteners 36 and removing the top mounting 22 together with the lamp and the lamp support 17. Different types of lamp may be used in the apparatus and each type can be held on its own individual support and secured into the apparatus when required. It is important that the lamp should be adjacent to the diffuser 23 so that no light passes directly onto the subject being illuminated. Because different types of lamp have different lengths, the mounts for different lamps are of corresponding different lengths to ensure that each lamp is located adjacent to the diffuser; thus a tungsten halogen lamp, which may be longer than an MSR lamp, has a shorter mount than the MSR lamp mount. When the lamp is an MSR lamp, an igniter 35 is provided.

More than one lamp may be located in the apparatus at any one time, in which case the lamps may be of the same or different type and the same or different wattage.

While this invention has been described in conjunction with specific embodiments thereof, it is evident that many alternatives, modifications and variations will be apparent to those skilled in the art. Accordingly, the preferred embodiments of the invention as set forth herein, are intended to be illustrative, not limiting. Various changes may be made without departing from the true spirit and full scope of the invention as set forth herein and defined in the following claims.

I claim:

1. A lighting apparatus for illuminating a subject without casting an appreciable shadow, comprising:

a holder for holding a lamp;

a reflector for reflecting light from the lamp towards the subject, and an element disposed in front of the lamp for preventing light from the lamp from passing directly from the lamp onto the subject, said reflector comprising a reflecting surface at least 500 mm in diameter having a plurality of domed convex light-reflecting elements, said light-reflecting elements each having a diameter of from 0.5 mm to 20 mm, said light-reflecting elements constituting at least 90% of an area of the reflecting surface.

2. An apparatus as claimed in claim 1, wherein the diameter of light-reflecting elements is less than 15 mm.

3. An apparatus as claimed in claim 2, which has an angle of divergence in the range of 50° to 150°.

4. An apparatus as claimed in claim 3, which has an angle of divergence in the range of 50° to 150°.

5. An apparatus as claimed in claim 4, wherein the convex light reflecting elements constitute at least 95% (by area) of the area of the reflecting surface.

6. An apparatus as claimed in claim 5, wherein a tangent of each convex light-reflecting element at a place where said convex light-reflecting element meets an adjacent element is at an angle of 25° to 75°, to an orthogonal to the reflector surface at that place.

7. An apparatus as claimed in claim 3, wherein a tangent of each convex light-reflecting element at a place where said convex light-reflecting element meets an adjacent element is at an angle of 25° to 75°, to an orthogonal to the reflector surface at that place.

8. An apparatus as claimed in claim 1, which has an angle of divergence of 50° to 150°.

9. An apparatus as claimed in claim 8, wherein said angle of divergence is in the range is in the range of 60° to 120°.

10. An apparatus as claimed in claim 1, wherein the convex elements on the reflecting surface are of at least two different radii of curvature and/or of at least two different diameters.

11. An apparatus as claimed in claim 1, wherein each convex light reflecting element is positioned adjacent other light reflecting elements, at least some of which are of different diameters or radii of curvature to said each light reflecting element.

12. An apparatus as claimed in claim 1, wherein the convex reflecting elements constitute at least 95% of the area of the reflecting surface.

13. An apparatus as claimed in claim 1, wherein substantially the whole of the reflecting surface is constituted by convex reflecting elements.

14. An apparatus as claimed in claim 1, wherein each convex reflecting element has a mirrored surface.

15. An apparatus as claimed in claim 1, wherein a tangent of each convex light-reflecting element at a place where said convex light-reflecting element meets an adjacent element is at an angle of 25° to 75°, to an orthogonal to the reflector surface at that place.

16. An apparatus as claimed in claim 1, wherein the diameter of convex light-reflecting elements is generally in the range of 3 to 10 mm.

17. An apparatus as claimed in claim 1, wherein a tangent of each convex light-reflecting element at a place where said convex light-reflecting element meets an adjacent element is at an angle of 45° to 60° to an orthogonal to the reflector surface at that place.

18. An apparatus as claimed in claim 1, wherein the holder is a lamp socket.

19. An apparatus as claimed in claim 1, wherein the element is a diffuser.

* * * * *